US010798511B1

(12) United States Patent
Sheaffer et al.

(10) Patent No.: US 10,798,511 B1
(45) Date of Patent: Oct. 6, 2020

(54) PROCESSING OF AUDIO SIGNALS FOR SPATIAL AUDIO

(71) Applicant: Apple Inc., Cupertino, CA (US)

(72) Inventors: Jonathan D. Sheaffer, Sunnyvale, CA (US); Juha O. Merimaa, San Mateo, CA (US); Jason Wung, Culver City, CA (US); Martin E. Johnson, Los Gatos, CA (US); Peter A. Raffensperger, Cupertino, CA (US); Joshua D. Atkins, Los Angeles, CA (US); Symeon Delikaris Manias, Los Angeles, CA (US); Mehrez Souden, Los Angeles, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/378,438

(22) Filed: Apr. 8, 2019

Related U.S. Application Data

(60) Provisional application No. 62/730,928, filed on Sep. 13, 2018.

(51) Int. Cl.
*H04S 5/00* (2006.01)
*G10K 11/178* (2006.01)
*H04R 1/40* (2006.01)

(52) U.S. Cl.
CPC ..... *H04S 5/00* (2013.01); *G10K 11/17853* (2018.01); *H04R 1/406* (2013.01); *H04S 2420/01* (2013.01)

(58) Field of Classification Search
CPC ..... H04S 2420/01; H04S 5/00; H04R 1/406; G10K 11/17853
USPC ..... 381/17
See application file for complete search history.

(56) References Cited

U.S. PATENT DOCUMENTS

| | | | |
|---|---|---|---|
| 7,567,845 | B1 | 7/2009 | Avendano et al. |
| 2018/0090150 | A1 | 3/2018 | Merimaa et al. |
| 2018/0091920 | A1* | 3/2018 | Family ..... H04S 7/304 |

OTHER PUBLICATIONS

Alexandridis, Anastasios, et al., "Capturing and Reproducing Spatial Audio Based on a Circular Microphone Array", Journal of Electrical and Computer Engineering, vol. 2013, Feb. 13, 2013, 17 pages.

Berge, Svein, et al., "High Angular Resolution Planewave Expansion", Proc. of the 2nd International Symposium on Ambisonics and Spherical Acoustics, May 6, 2010, 6 pages.

(Continued)

*Primary Examiner* — Paul Kim
(74) *Attorney, Agent, or Firm* — Womble Bond Dickinson (US) LLP

(57) ABSTRACT

Processing input audio channels for generating spatial audio can include receiving a plurality of microphone signals that capture a sound field. Each microphone signal can be transformed into a frequency domain signal. From each frequency domain signal, a direct component and a diffuse component can be extracted. The direct component can be processed with a parametric renderer. The diffuse component can be processed with a linear renderer. The components can be combined, resulting in a spatial audio output. The levels of the components can be adjusted to match a direct to diffuse ratio (DDR) of the output with the DDR of the captured sound field. Other aspects are also described and claimed.

19 Claims, 5 Drawing Sheets

(56) References Cited

OTHER PUBLICATIONS

Cobos, Maximo, et al., "A Sparsity-Based Approach to 3D Binaural Sound Synthesis Using Time-Frequency Array Processing", EURASIP Journal on Advances in Signal Processing, vol. 2010, Sep. 7, 2010, 13 pages.
Delikaris-Manias, Symeon, "Parametric spatial audio processing utilising compact microphone arrays", Aalto University publication series Doctoral Dissertation, 2017, 84 pages.
Habets, Emanuel A. P., et al., "Linear and Parametric Microphone Array Processing", ICASSP, 2013, 51 pages.
Merimaa, Juha, "Analysis, Synthesis, and Perception of Spatial Sound—Binaural Localization Modeling and Multichannel Loudspeaker Reproduction", Doctoral Dissertation, Helsinki University of Technology Laboratory of Acoustics and Audio Signal Processing, 2006, 196 pages.
Pulkki, Ville, et al., "Spatial Impulse Response Rendering: A Tool for Reproducing Room Acoustics for Multi-Channel Listening", Helsinki University of Technology Laboratory of Acoustics and Audio Signal Processing, 2019, 8 pages.
Zhang, Wen, et al., "Surround by Sound: A Review of Spatial Audio Recording and Reproduction", Appl. Sci. 2017, 7, 532, May 20, 2017, 19 pages.

* cited by examiner

PROCESSING OF AUDIO SIGNALS FOR SPATIAL AUDIO

CROSS-REFERENCE TO RELATED APPLICATIONS

This application claims priority to U.S. Provisional Patent Application No. 62/730,928, filed Sep. 13, 2018.

FIELD

One aspect of the disclosure herein relates to a hybrid approach to spatial audio processing by a parametric renderer and a linear renderer.

BACKGROUND

Microphone arrays, which can be embedded in consumer electronic devices (for example, a mobile phone or tablet), can facilitate a means for capturing and rendering spatial (3D) sound. The microphone signals of a microphone audio (also referred to here as multi-channel sound pickup) capture a 3D sound scene. 3D audio rendering can be described as the processing of an audio signal (such as a microphone signal or other recorded audio content) so as to yield sound produced by stereo speakers, surround-sound speakers, speaker arrays, or headphones that is perceived by the listener as coming from a particular direction or all around the listener in three-dimensional space. For example, one or more of such virtual sound sources can be generated in a sound program that will be perceived by a listener to be behind, above or below the listener, or panned from one side of the listener to another.

SUMMARY

Algorithms that process multi-channel captured sound for reproducing as 3D audio can be classified as linear or parametric. Linear algorithms do not depend on the content being recorded. They can be described as a set of linear filters applied to the microphone signals.

Linear processing algorithms beneficially place a light computational load on a processor. Spatial resolution of the audio output resulting from linear processing, however, can be severely restrained by the number of microphones employed to capture the sound field for recording. A high number of microphones may be needed to achieve a quality spatial resolution. The number of microphones that are present in devices, however, can be limited by both physical factors (e.g. space and power consumption) and economic factors (e.g. cost and device complexity).

In contrast, parametric spatial sound processing can offer considerably improved spatial resolution for a relatively low microphone count, which is achieved by making some underlying assumptions on the sound field being recorded. Based on the underlying assumptions, parameters for filters can be estimated. For example, one such assumption is that, at each point in time and at each frequency (i.e. in each processed sub-band) there is only one active sound source. This assumption may enable filter parameters to be estimated based on the direction of arrival (DOA) of the sound field. When this assumption is violated, under moderately reverberant, highly reverberant or diffuse conditions, the resulting output audio can become contaminated with unwanted processing artifacts. Thus, recording and processing 3D sound with a limited number of microphones and limited processor bandwidth can be a challenge. In one aspect, the methods and systems described herein can increase the spatial resolution achievable from a microphone array with a low count of microphones, while reducing the likelihood of processing artifacts and reducing processing cost or complexity.

In one aspect, an audio signal processing method employs linear dereverberation to extract a diffuse component and a direct component from a multichannel captured sound field. The diffuse component is then spatially rendered at each sub-band (e.g., each sub-band is rendered independently of other sub-bands), by a linear renderer, while the direct component is spatially rendered at each sub-band by a parametric renderer. The resulting rendered channels (direct and diffuse) can then be summed together. The summed channels can be delivered to a target speaker output system. For example, the process may produce rendered and summed channels that are the inputs of a 5-channel speaker output system or that are the input of a 2-channel headphone system.

In one aspect, a method is described that uses a beamforming least-squares fit. A diffuse component of a sound field is rendered by a linear renderer. The linear renderer can be a beamformer using a least-squares fit to generate binaural audio from a diffuse component of a sound field.

In one aspect, band-splitting is implemented that can reduce artifacts caused by parametric processing in outer frequency bands. For example, upper and lower frequency bands of the original sound field are processed by a linear renderer. The direct component can be extracted from the original sound field and then sub-bands that are within the frequency limits can be processed by a parametric renderer.

In one aspect, a method is described that enforces a captured sound field's original direct to diffuse ratio (DDR) or direct to reverberant ratio (DRR), when reproducing the captured sound field. In such a method, the levels of rendered diffuse channels can be adjusted to match a calculated, original DDR or DRR. The (adjusted) diffuse channels can then be summed with rendered direct channels to generate a rendered (or reproduced) sound field with a DDR/DRR that matches the DDR/DRR of the captured sound field.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

Signal Flow

Figure 1:
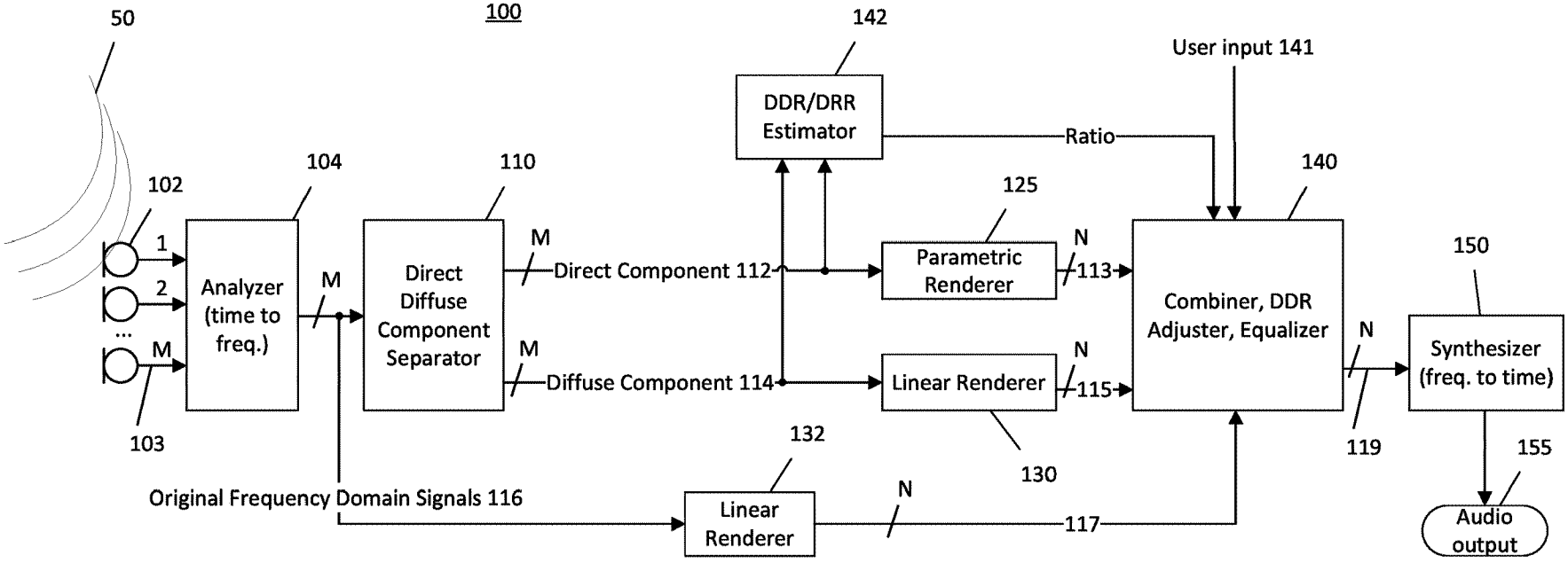
FIG. 1 illustrates a diagram of a system or device that generates spatial audio.

Referring now to FIG. 1, a system 100 is shown relating to hybrid processing of microphone array recordings for spatial audio with parametric and linear renderers. The system (which can take the form of a device or article of manufacture) can be, for example, a laptop computer, a desktop computer, a mobile phone, a smart phone, a tablet computer, a smart speaker, or an infotainment system for an automobile or other vehicle.

In one aspect, a system or device includes M number of microphones 102 to generate M digital audio signals 103. The analyzer 104 converts the M signals into M original frequency domain signals 116 (each being a sequence over time of segments or frames of sub-band values.) The direct diffuse component separator 110 outputs M signals which can be described as a direct component 112 and M signals which can be described as a diffuse component 114.

The direct component may refer to a sound field that has a single sound source with a single direction, for example, without any reverberant sounds. The diffuse component or "diffuse sound" may refer to a sound field with sound energy in all directions, including reverberant sound and ambient sound. "Reverberant" sound may refer to secondary effects of sound, for example, when sound energy reflects off of surfaces and causes echoing.

It should be understood that the direct component may contain some diffuse sounds and the diffuse component may contain some directional, because separating the two completely can be impracticable and/or impractical. Thus, the diffuse component 114 may contain primarily diffuse sounds where the directional sounds have been substantially removed as much as practicable or practical. Similarly, the direct component 112 contains primarily directional sounds, where the diffuse sounds have been substantially removed as much as practicable or practical.

The renderers 125, 130, and 132, then can render the inputs over N number of output channels. N can be greater than (upmixing), less than (downmixing), or equal to the number M of input signals. The combiner 140 can combine the N output channels 113, 115, and 117 into a combined, adjusted and equalized output (e.g., a rendered sound field) 119, also having the N channels. The rendered sound field 119 can be stored in memory and/or processed by the synthesizer 150. The synthesizer can then convert the N channels of output 119 into an audio output 155 having N time domain output channels which can be stored in electronic memory and/or output to an audio output 155, for example speakers or headphones with N inputs.

The signals 103 and 119 can thus be M and N time domain signals, respectively. The rest of the signals 112, 114, 116 can be M frequency domain signals, and signals 113, 115, 117 and 119 can be N frequency domain signals. The frequency domain signals can be, for example, in the form of sub-bands of segmented time frames, as discussed in further detail herein.

Microphones

As shown in FIG. 1, a plurality of microphones 102 capture a sound field 50. Each microphone generates a corresponding digital audio signal 103, for example, time domain signals. The microphones 102 can be microphone arrays with known, fixed, and/or determinable relative positions.

Analyzer

The analyzer 104 receives the microphone signals and transforms each signal from the time domain to the frequency domain. In one embodiment, the analyzer 104 can transform each signal on a frame by frame basis into the frequency domain (also referred to as spectral domain). For example, the time-frequency analysis can be performed using known methods, for example, a Fourier transform, filter banks, discrete Fourier transform (DFT), short time Fourier Transform (STFT), or other equivalent time-frequency analysis techniques known in the art. In one embodiment, the Analyzer 104 can perform STFT, transforming the microphone signals into original frequency domain signals 116, where each frequency domain signal can be in the form of sub-bands (e.g. frequency bands) of segmented time frames.

Direct Diffuse Component Separator

A direct diffuse component separator 110 can extract, from each original frequency domain signal, a direct component 112, and a diffuse component 114. Like the original frequency domain signals, the extracted direct and diffuse components can also be in the form of sub-bands of segmented time frames.

Figure 3:
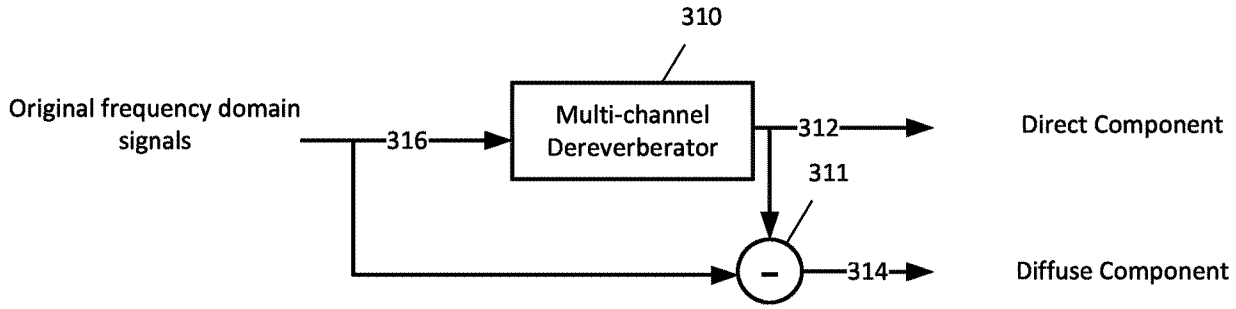
FIGS. 3-5 illustrate aspects of a direct diffuse component separator.

In one aspect, the direct diffuse component separator shown in FIG. 3 can include a multi-channel dereverberator 310 that performs linear dereverberation on each original frequency domain signal and output a dereverberated direct component 312. The dereverberated direct component 312 can be fed into a subtractor 311, to subtract the direct component from the original frequency domain signals 316, resulting in the diffuse component 314.

Figure 4:
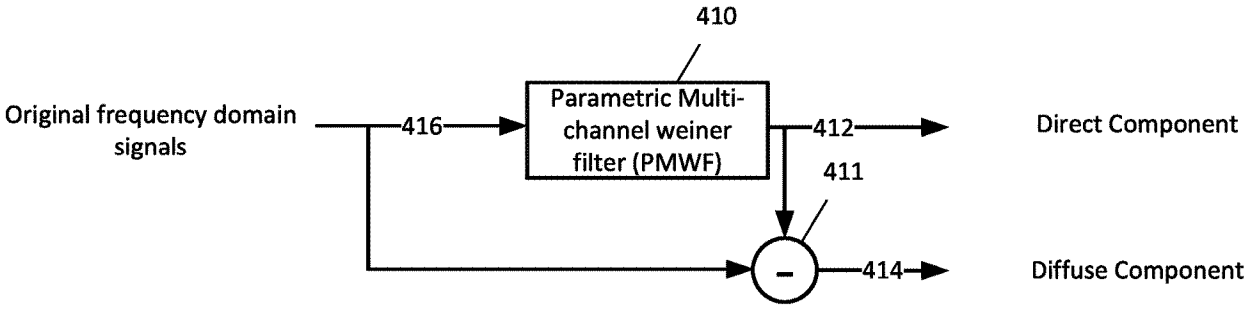

In one aspect, the direct diffuse component separator shown in FIG. 4 can include a parametric multi-channel Wiener filter (PMWF) 410 that calculates filter parameters and applies the parameters to each original frequency domain signal. The PMWF outputs a dereverberated and de-noised direct component 412. The direct component 412 can be fed into a subtractor 411, to subtract the direct component from the original frequency domain signals 416, resulting in the diffuse component 414.

Figure 5:
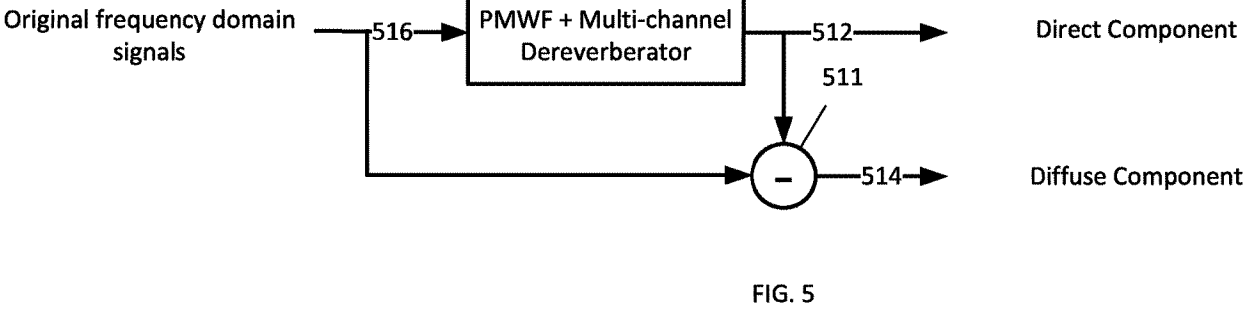

In one aspect, the direct diffuse separator shown in FIG. 5 can include a parametric multi-channel Wiener filter (PMWF) 510 and a multi-channel dereverberator 513. The two blocks can be performed on each original frequency domain signal 516. By utilizing both a PMWF and a multi-channel dereverberator, the output direct component 512 can have minimized speech distortion, noise, and reverberation. The direct component 512 can be fed into a subtractor 511, to subtract the direct component from the original frequency domain signals 516, resulting in the diffuse component 514.

Parametric Renderer

Referring back to FIG. 1, the direct component can be processed by a parametric renderer 120. The parametric renderer can estimate a direction of arrival (DoA) at each sub-band of the direct component, resulting in a plurality of DoA values. The DoA values can be used as filter parameters, applied to the direct component.

The parametric renderer can pan the direct component signal using a predefined panning function with the DoA values over output channels, resulting in a plurality of rendered direct channels. The parametric renderer can perform parameter smoothing of DoA values, including spatial smoothing, temporal smoothing, spectral smoothing, or combinations thereof.

Linear Renderer

The diffuse component 114 can be processed by the linear renderer 130. The linear renderer can generate beamforming weights to meet a target spatial response. The beamforming weights can be optimized to a target spatial response using a target-based beam-pattern synthesis technique. The linear renderer can apply the beamforming weights to the diffuse component and render the diffuse component over output channels, resulting in a plurality of rendered diffuse channels 113. In one aspect, the beamforming weights are optimized to a target spatial response using a least-squares fit.

In one aspect, the target spatial response can be, for example, a head related transfer function (HRTF). In another aspect, the target spatial response can be a loudspeaker system where the beamforming weights are formed to produce monophonic beams. The beams can have beam directions aligned with each loudspeaker of the loudspeaker system. For example, the linear renderer 130 can be a non-time varying beamformer or plane wave generator.

It should be understood that the output of the renderers 125, 130 and 132 can have a varying number of channels either greater than (upmixed), less than (downmixed), or equal to, the number of input audio signals captured by the microphones 102. For example, the system or device can include 2 microphones output can have 5 channels, for a 5.1

Band-Splitting

In one aspect, the original frequency domain signals 116 are split based on a high frequency limit and a low frequency limit. The frequency sub-bands above and/or below the respective frequency limits are processed by a second linear renderer 132, as shown in FIG. 1. Unlike linear renderer 130 and parametric renderer 120, the second linear renderer 132 processes the originally captured sound field containing both direct and diffuse sound components. The second linear renderer 132 can select outer bands for processing, for example, frequency sub-bands that are greater than and/or less than a high frequency limit and a low frequency limit. The outer bands are then processed by the linear renderer 132 to maintain an accurate portrayal of the original sound.

Additionally or alternatively, the parametric renderer 125 can perform parametric rendering only within the frequency limits. For example, if the high frequency limit is 15 KHz and the low frequency limit is 200 Hz, the parametric renderer can process frequency bands of the direct component between 15 KHz and 200 Hz, and the second linear renderer 132 can process frequency bands of the signals 116 greater than 15 KHz and less than 200 Hz. In this manner, the system advantageously avoids audible artifacts that can be caused by parametric rendering when performed outside of frequency limits.

Similar to linear renderer 130, linear renderer 132 can generate beamforming weights to a target spatial response. The beamforming weights can be optimized to a target spatial response using a least-squares fit. The linear renderer 132 can apply the beamforming weights to the outer bands of the original frequency domain signals 116 and render the product over output channels, resulting in a plurality of rendered outer band channels 117. The rendered outer band channels can be received by the combiner 140 and summed with the direct and diffuse component.

The high and low frequency limits are capable of being determined by experimentation, test, or estimation. For example, based on experimentation, the parametric renderer may be found to generate unwanted audible artifacts at a high frequency limit and/or low frequency limit in which a stable DoA estimation cannot be obtained. The limits may vary based on different factors, for example, the geometry of the microphone array (e.g., the relative locations of the microphones to each other).

Combiner, DDR Adjuster, Equalizer, and DDR/DRR Estimator

In one aspect, a combiner, DDR adjuster, equalizer 140 (or 'combiner' for short) receives and sums the rendered direct channels 113 and the rendered diffuse channels 115. In addition the combiner can then adjust levels of the rendered diffuse channels 115 or the direct channels 113, for example, at each sub-band, so that an estimated DDR or DRR of the rendered sound field 119 matches a target DDR or target DRR. The combiner 140 can estimate the DDR or DRR of the rendered sound field 119 by comparing the levels of the rendered direct channels 113 and rendered diffuse channels 115 prior to combining them. The combiner can then combine the plurality of rendered direct channels and the plurality of rendered diffuse channels For example, if upon comparison, ratio between the rendered direct and diffuse channels does not match the target DDR or DRR, the combiner can adjust the level of the diffuse channels to be higher or lower, so that they ratios match. Advantageously, the level adjustments can be performed on each sub-band of the diffuse and/or direct component independently, thus equalizing the combined audio output and ensuring that the timbre of the linear processing matches that of the parametric processing.

In one aspect, the target DDR can be based on the input DDR or DRR. A DDR estimator 142 can calculate an input DDR or DRR at each at each sub-band of each signal. The input DDR or DRR can be calculated by comparing the energy between the direct component 112 and the diffuse component 114, to calculate a ratio.

In one aspect, the combiner can also receive a user input 141. The combiner can use the input as a DDR or DRR multiplier and adjust the levels of the rendered channels 113 and/or 115 based on the multiplier, hence allowing for users to customize the output DDR or DRR (e.g., the reverberation) to taste and facilitating a means for more advanced features such as audio focus and audio zooming.

In one aspect, the combiner can adjust the levels of the rendered channels 113 and/or 115 based on settings stored in memory, user inputs, the input DDR/DRR, or combinations thereof. In one aspect, the combiner can generate meta-data, including the input DDR and/or DRR and the output DDR/DRR and store the meta-data in electronic memory, and/or use this meta-data to adjust the levels and sum the direct component and diffuse components, resulting in an output frequency domain signal, for example, in the form of sub-bands of segmented time frames.

Synthesizer

In one aspect, the output frequency domain signal (e.g. having summed and equalized direct and diffuse components) can be received by a synthesizer 150. The synthesizer performs time-frequency analysis (for example, standard STFT synthesis, inverse Fourier transform, and other known techniques) and converts the output frequency domain signal to an output time domain signal. The audio output 155 of the synthesizer can be synthesized time domain channels used to drive a speaker system or headphones.

In one aspect, the audio output and/or the rendered sound field 119 can be stored in computer memory as a sound recording. Alternatively or additionally, the direct and diffuse channels 113 and 115 can be stored in computer memory prior to combining, along with meta-data (such as, for example, a target DDR/DRR calculated by DDR/DRR estimator 142, or a user input 141, or DDR/DRR values stored in electronic memory, and number of output channels), as a sound recording, capable of being combined at a different time and/or by a different device. Beneficially, the audio output contains an improved spatial audio (3D) without audible artifacts, while maximizing the potential spatial rendering of a low-count microphone recording.

Hybrid Process with Linear and Parametric Renderer

Figure 2:
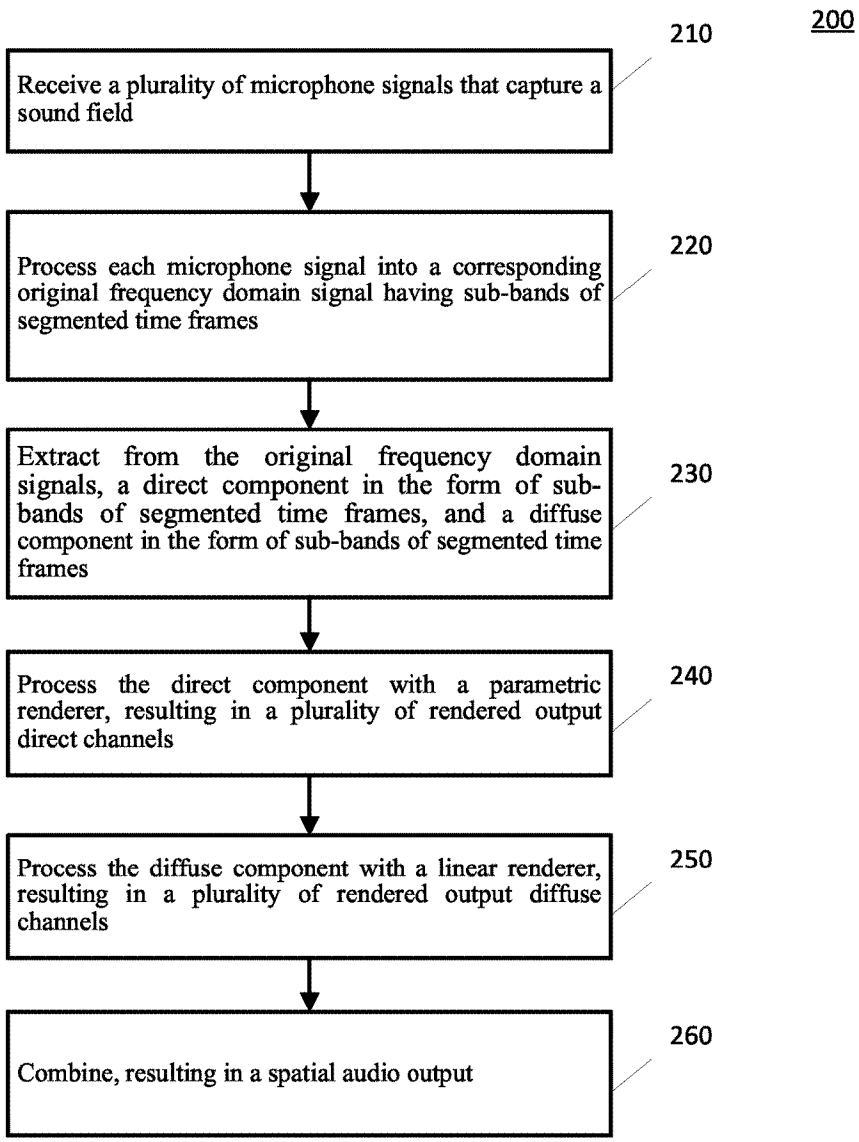
FIG. 2 illustrates a flow diagram for a process that generates spatial audio.

FIG. 2 illustrates a flowchart for providing a general overview of the hybrid processing of microphone array recordings for spatial audio with parametric and linear processing in accordance with one example aspect. The following aspects may be described as a process 200, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc. Process 200 may be performed by processing logic that includes hardware (e.g. circuitry, dedicated logic, etc.), software (e.g., embodied on a non-transitory computer readable medium), or a combination thereof.

Referring to FIG. 2, in block 210, the audio processing system receives a plurality of microphone signals that capture a sound field (e.g., a multichannel input signal in the time-domain). The microphones can be integral to the audio processing system or detached. The microphone signals can be generated from a microphone array, where each microphone has a known or determinable position relative to each another, to calculate directionality of captured sounds.

In block 220, the system processes each microphone signal into a corresponding original frequency domain signal, for example, one having sub-bands of segmented time frames. In other words, the multichannel input signal is converted into a frequency domain representation using a suitable time frequency transform, for example a short-time Fourier transform.

In block 230, the system can extract from each original frequency domain signal, a direct component in the form of sub-bands of segmented time frames, and a diffuse component in the form of sub-bands of segmented time frames. The extraction process can be performed with a multi-channel dereverberator, a PMWF, or combinations thereof.

In block 240, the system can process the direct component with a parametric renderer, resulting in a plurality of rendered output direct channels. In block 250, the system can process the diffuse component with a linear renderer, resulting in a plurality of rendered output diffuse channels.

In block 260, the system can combine, resulting in a spatial audio output. Combining can include adjusting the levels of the diffuse component as described in detail herein to customize the reverberation or diffuse level of the output audio, or to match the output audio with the DDR or DRR of the original captured sound field. The system can then sum the rendered output direct channels with the rendered output diffuse channels.

Process of Generating Binaural Audio with Least-Squares Fit

Figure 7:
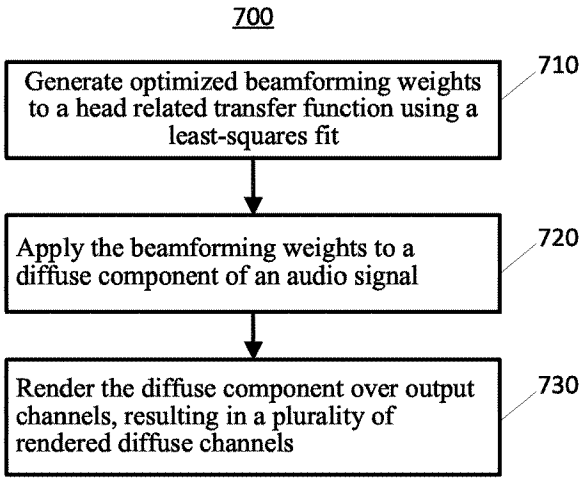
FIG. 7 illustrates a flow diagram for a process of linear rendering.

FIG. 7 illustrates a flowchart for generating binaural audio from the diffuse or reverberant component of a sound field using a least-squares method in accordance with one example aspect. The following aspects may be described as a process 700, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc. Process 700 may be performed by processing logic that includes hardware (e.g. circuitry, dedicated logic, etc.), software (e.g., embodied on a non-transitory computer readable medium), or a combination thereof.

In block 710, the process can generate optimized beamforming weights to a head related transfer function using a least-squares fit. The method of least-squares is an approach in regression analysis to approximate the solution of overdetermined systems, i.e., sets of equations in which there are more equations than unknowns. "Least-squares" means that the overall solution minimizes the sum of the squares of the residuals made in the results of every single equation. The best fit in the least-squares sense minimizes the sum of squared residuals where a residual can be described as the difference between an observed value, and the fitted value provided by a model.

In block 720, the process can apply the beamforming weights to a diffuse component of an audio signal. The audio signal, in this case, can be a set of frequency domain signals that characterize a sound field, for example, generated by a microphone array. The diffuse component can include reverberant sound and ambient sounds, but contains minimal or zero directional sounds.

In block 730, the process can render the diffuse component over output channels, resulting in a plurality of rendered diffuse channels. The rendered diffuse channels can be used to form binaural audio, for example, by combining the diffuse channels with direct channels, as described herein.

Process of Enforcing an Original DDR or DRR in Spatial Recording

Figure 8:
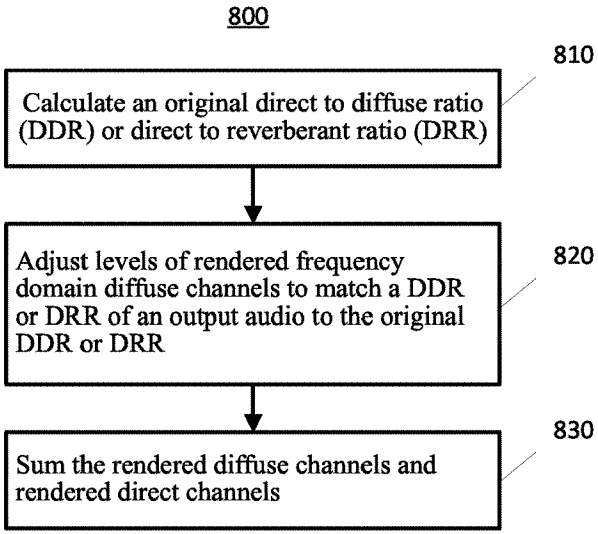
FIG. 8 illustrates a flow diagram for a process that performs DDR/DRR matching.

FIG. 8 illustrates a flowchart for generating binaural audio from the diffuse or reverberant component of a sound field using a least-squares method in accordance with one example aspect. The following aspects may be described as a process 800, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc. Process 800 may be performed by processing logic that includes hardware (e.g. circuitry, dedicated logic, etc.), software (e.g., embodied on a non-transitory computer readable medium), or a combination thereof.

In block 810, the process can calculate an original direct to diffuse ratio (DDR) or direct to reverberant ratio (DRR) of a captured sound field. For example, the process can compare, at each sub-band of each signal from a microphone array, the direct component with the diffuse or reverberant component, and calculate the corresponding ratios.

In block 820, the process can adjust levels of rendered frequency domain diffuse channels or direct channels to match a DDR or DRR of an output audio to the original DDR or DRR. In other words, the levels of the rendered direct or diffuse channels can be adjusted so that the DDR/DRR of the output matches the original DDR/DRR calculated in block 810.

In block 830, the process can sum the rendered diffuse channels and rendered direct channels. Beneficially, the output sound can have spatial audio while maintaining the original DDR or DRR of the captured sound field.

Thus, an aspect of the disclosure here is a method of enforcing an original DRR in spatial recording. The method can include: calculating an original direct to diffuse ratio (DDR) or direct to reverberant ratio (DRR) at each sub-band of a plurality of original audio frequency domain signals; adjusting levels of rendered frequency domain diffuse channels to match a DDR or DRR of an output audio to the original DDR or DRR; and summing the rendered diffuse channels and rendered direct channels.

Process of Hybrid Linear and Parametric Processing

Figure 9:
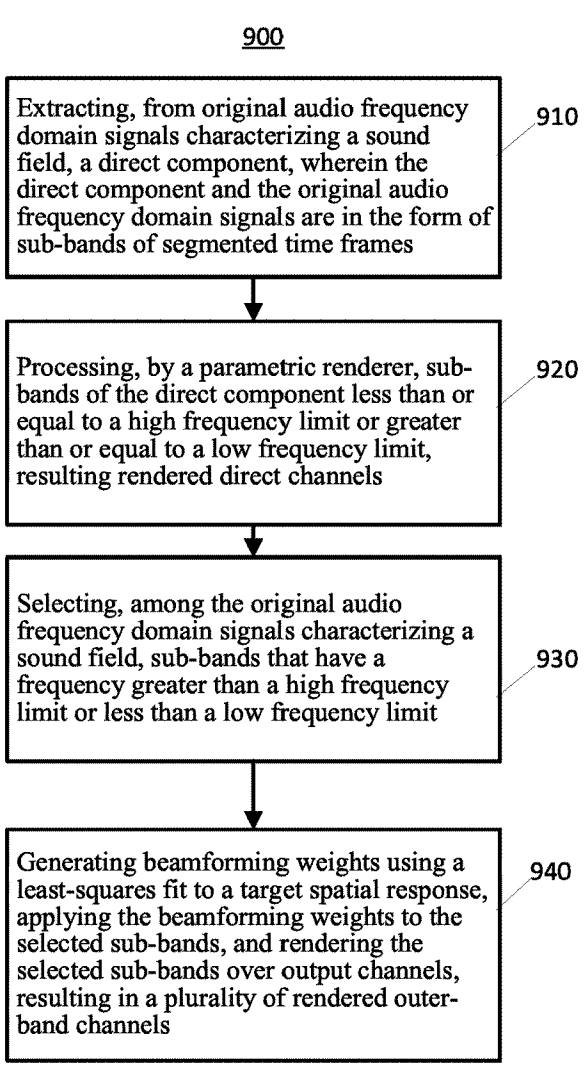
FIG. 9 illustrates a flow diagram for a process that performs band-splitting.

FIG. 9 illustrates a flowchart for generating binaural audio from the diffuse or reverberant component of a sound field using a least-squares method in accordance with one example aspect. The following aspects may be described as a process 900, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc. Process 900 may be performed by processing logic that includes hardware (e.g. circuitry, dedicated logic, etc.), software (e.g., embodied on a non-transitory computer readable medium), or a combination thereof.

In block 910, the process extracts, from original audio frequency domain signals characterizing a sound field, a direct component. The direct component and the original audio frequency domain signals are in the form of sub-bands of segmented time frames.

In block 920, the process processes, by a parametric renderer, sub-bands of the direct component less than or equal to a high frequency limit or greater than or equal to a low frequency limit. The resulting output of the parametric renderer can be rendered direct channels. The number of rendered direct channels can be greater than or less than the original audio frequency domain signals, depending on application. The frequency limits can vary based on the geometry of the microphone array capturing the sound field. The limits can be determined based on estimation or experimentation, for example, by testing the outer limits based on whether or not audible artifacts are present in the output audio.

In block 930, the process can select, among the original audio frequency domain signals characterizing a sound field, sub-bands that have a frequency greater than a high frequency limit or less than a low frequency limit. In this manner, blocks 920 and 930 split the processing of the frequency bands of the original audio frequency domain signals. It should be noted, however, that the parametric renderer processes sub-bands of the direct component, whereas the selection of the outer sub-bands (e.g., the bands outside of the frequency limits) are based on the original audio frequency domain signals (without separation of direct or diffuse sound).

In block 940, the process generates beamforming weights using a least-squares fit to a target spatial response. The beamforming weights are applied to the selected sub-bands. The selected sub-bands are rendered over output channels, resulting in a plurality of rendered outer-band channels.

The direct component and the original audio frequency domain signals can be in the form of sub-bands of segmented time frames, for example, as a result of performing STFT analysis on the original audio time domain signals capturing the sound field.

Thus, an aspect of the disclosure here is a method of hybridizing linear and parametric processing. The method can include: extracting, from original audio frequency domain signals characterizing a sound field, a direct component, wherein the direct component and the original audio frequency domain signals are in the form of sub-bands of segmented time frames; processing, by a parametric renderer, sub-bands of the direct component that are less than or equal to a high frequency limit or greater than or equal to a low frequency limit, resulting rendered direct channels; selecting, among the original audio frequency domain signals characterizing a sound field, sub-bands that have a frequency greater than a high frequency limit or less than a low frequency limit; generating beamforming weights using a least-squares fit to a target spatial response; applying the beamforming weights to the selected sub-bands; and rendering the selected sub-bands over output channels, resulting in a plurality of rendered outer-band channels.

Figure 6:
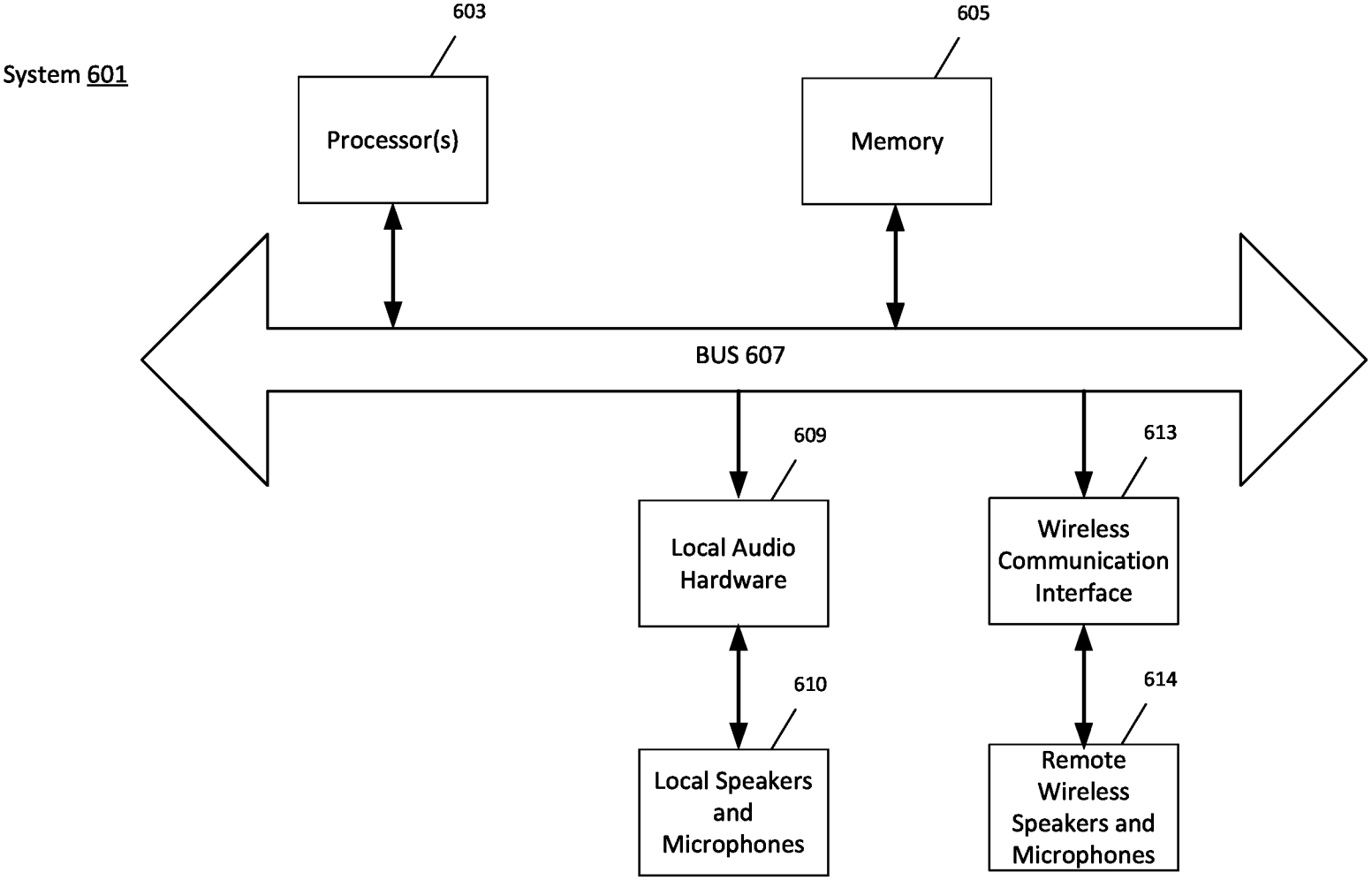
FIG. 6 illustrates an example implementation of an audio system having a programmed processor.

FIG. 6 shows a block diagram for explaining an example of an audio processing system hardware which may be used with any of the aspects described herein. This audio processing system can represent a general purpose computer system or a special purpose computer system. Note that while FIG. 6 illustrates the various components of an audio processing system that may be incorporated into headphones, speaker systems, microphone arrays and entertainment systems, it is merely one example of a particular implementation and is merely to illustrate the types of components that may be present in the audio processing system. FIG. 6 is not intended to represent any particular architecture or manner of interconnecting the components as such details are not germane to the aspects herein. It will also be appreciated that other types of audio processing systems that have fewer components than shown or more components than shown in FIG. 6 can also be used. Accordingly, the processes described herein are not limited to use with the hardware and software of FIG. 6.

As shown in FIG. 6, the audio processing system 601 (for example, a laptop computer, a desktop computer, a mobile phone, a smart phone, a tablet computer, a smart speaker, or an infotainment system for an automobile or other vehicle) includes one or more buses 607 that serve to interconnect the various components of the system. One or more processors 603 are coupled to bus 607 as is known in the art. The processor(s) may be microprocessors or special purpose processors, system on chip (SOC), a central processing unit, a graphics processing unit, a processor created through an Application Specific Integrated Circuit (ASIC), or combinations thereof. Memory 605 can include Read Only Memory (ROM), volatile memory, and non-volatile memory, or combinations thereof, coupled to the bus 607 using techniques known in the art.

Memory can include DRAM, a hard disk drive or a flash memory or a magnetic optical drive or magnetic memory or an optical drive or other types of memory systems that maintain data even after power is removed from the system. In one aspect, the processor 603 retrieves computer program instructions stored in a machine readable storage medium (memory) and executes those instructions to perform operations described herein.

Local audio hardware 609 is coupled to the one or more buses 607 in order to receive audio signals to be processed and output by local speakers 610. Local audio hardware 609 can comprise digital to analog and/or analog to digital converters. Local hardware 609 can also include audio amplifiers and filters. The Local audio hardware can also interface with local microphones (e.g., microphone arrays) to receive audio signals (whether analog or digital), digitize them if necessary, and communicate the signals to the bus 607. Local microphones and local speakers can be located in the same housing as the system 601, for example, they can be speakers in a mobile phone, tablet, smart speaker, or other forms that system 601 can take.

Wireless communication interface 613 can communicate with remote devices and networks. For example, wireless communication interface 613 can communicate over known technologies such as Wi-Fi, 3G, 4G, 5G, Bluetooth, ZigBee, or other equivalent technologies. Wireless communication interface 613 can communicate (e.g., receive and transmit data) with networked devices such as servers (e.g., the cloud) and/or other devices such as remote wireless speakers and microphones 614. Remote speakers and microphones can also be connected be integrated into system 601 through wired connections, as known in the art.

It will be appreciated that the aspects disclosed herein can utilize memory that is remote from the system, such as a network storage device which is coupled to the audio processing system through a network interface such as a modem or Ethernet interface. The buses 607 can be connected to each other through various bridges, controllers and/or adapters as is well known in the art. In one aspect, one or more network device(s) can be coupled to the bus 607. The network device(s) can be wired network devices (e.g., Ethernet) or wireless network devices (e.g., WI-FI, Bluetooth).

Various aspects descried herein may be embodied, at least in part, in software. That is, the techniques may be carried out in an audio processing system in response to its processor executing a sequence of instructions contained in a storage medium, such as a non-transitory machine-readable storage medium (e.g. DRAM or flash memory). In various aspects, hardwired circuitry may be used in combination with software instructions to implement the techniques described herein. Thus the techniques are not limited to any specific combination of hardware circuitry and software, or to any particular source for the instructions executed by the audio processing system.

In the description, certain terminology is used to describe features of various aspects. For example, in certain situations, the terms "analyzer", "separator", "renderer", "estimator", "combiner", "synthesizer", "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. As mentioned above, the software may be stored in any type of machine-readable medium.

Some portions of the preceding detailed descriptions have been presented in terms of algorithms and symbolic representations of operations on data bits within a computer memory. These algorithmic descriptions and representations are the ways used by those skilled in the audio processing arts to most effectively convey the substance of their work to others skilled in the art. An algorithm is here, and generally, conceived to be a self-consistent sequence of operations leading to a desired result. The operations are those requiring physical manipulations of physical quantities. It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of an audio processing system, or similar electronic device, that manipulates and transforms data represented as physical (electronic) quantities within the system's registers and memories into other data similarly represented as physical quantities within the system memories or registers or other such information storage, transmission or display devices.

The processes and blocks described herein are not limited to the specific examples described and are not limited to the specific orders used as examples herein. Rather, any of the processing blocks may be re-ordered, combined or removed, performed in parallel or in serial, as necessary, to achieve the results set forth above. The processing blocks associated with implementing the audio processing system may be performed by one or more programmable processors executing one or more computer programs stored on a non-transitory computer readable storage medium to perform the functions of the system. All or part of the audio processing system may be implemented as, special purpose logic circuitry (e.g., an FPGA (field-programmable gate array) and/or an ASIC (application-specific integrated circuit)). All or part of the audio system may be implemented using electronic hardware circuitry that include electronic devices such as, for example, at least one of a processor, a memory, a programmable logic device or a logic gate. Further, processes can be implemented in any combination hardware devices and software components.

While certain aspects have been described and shown in the accompanying drawings, it is to be understood that such aspects are merely illustrative of and not restrictive on the broad invention, and the invention is not limited to the specific constructions and arrangements shown and described, since various other modifications may occur to those of ordinary skill in the art. The description is thus to be regarded as illustrative instead of limiting.

For example, while FIG. 1 depicts a system or device in which a linear renderer 132 can process outer sub-bands (e.g., frequency bands above and below determined high and low frequency thresholds) of original frequency domain signals 116, it is also possible to not include the linear renderer 132. In this case, the parametric renderer can process frequency bands of the direct component 112 within the determined thresholds to avoid unwanted artifacts, or process all frequency bands of the direct component 112, if it is determined that unwanted artifacts will not be present or will not be an issue.

In another example, while FIG. 1 depicts a system or device having a DDR/DRR estimator 142 that computes a DDR or DRR, and a user input 141 that are both inputs to the combiner DDR adjuster and equalizer 140, it is also possible to only include one of the estimator or the user input, or neither. The combiner DDR adjuster and equalizer 140 can adjust the DDR output based on the DDR/DRR from the estimator 142, for example, by matching the output DDR to the DDR/DRR from the estimator 142. Alternatively or additionally, the combiner can set or modify the output DDR with the user input 141 used as a multiplier to the direct or diffuse component level. If neither user input nor DDR/DRR estimator is present, the combiner can adjust the output DDR/DRR based on settings and/or not adjust the levels of the diffuse or direct components prior to combining.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. A method for processing input audio channels for generating spatial audio, comprising:

receiving a plurality of microphone signals that capture a sound field;

processing each microphone signal into a corresponding original frequency domain signal having sub-bands of segmented time frames;

extracting, from the original frequency domain signals, a direct component in the form of sub-bands of segmented time frames, and a diffuse component in the form of sub-bands of segmented time frames;

processing the direct component with a parametric renderer, resulting in a plurality of rendered direct channels;

processing the diffuse component with a linear renderer, resulting in a plurality of rendered diffuse channels; and combining the plurality of rendered direct channels and the plurality of rendered diffuse channels, resulting in a spatial audio output.

2. The method of claim 1, wherein the parametric renderer:

estimates a direction of arrival (DoA) at each sub-band of the direct component, resulting in a plurality of DoA values; and pans a signal using a predefined panning function with the DoA values over output channels, resulting in a plurality of rendered direct channels.

3. The method of claim 2, wherein the parametric renderer further performs parameter smoothing of the DoA values, including spatial smoothing, temporal smoothing, or spectral smoothing.

4. The method of claim 1, wherein the linear renderer:

generates beamforming weights to a target spatial response using a least-squares fit;

applies the beamforming weights to the diffuse component; and renders the diffuse component over output channels, resulting in a plurality of rendered diffuse channels.

5. The method of claim 4, wherein the target spatial response is a head related transfer function (HRTF).

6. The method of claim 4, wherein the target spatial response is a loudspeaker system and the beamforming weights are formed to produce monophonic beams at directions of each loudspeaker in the loudspeaker system.

7. The method of claim 1, wherein processing with the parametric renderer, includes processing only sub-bands of the direct component that are less than or equal to a high frequency limit or greater than or equal to a low frequency limit.

8. The method of claim 7, further comprising:

processing, with a second linear renderer, sub-bands of the original frequency domain signal that are greater than the high frequency limit or less than the low frequency limit.

9. The method of claim 1, wherein the extracting includes:

processing the original frequency domain signals with a multi-channel de-reverberator to remove reverberant sound, resulting in a signal with only the direct component; and subtracting from the original frequency domain signals, the direct component, resulting in a signal with only the diffuse component.

10. The method of claim 1, wherein the extracting includes:

processing the original frequency domain signals with a parametric multi-channel Wiener filter to remove ambient noise, resulting in the direct component; and subtracting from the original frequency domain signals, the direct component, resulting in the diffuse component.

11. The method of claim 1, wherein the extracting includes:

processing the original frequency domain signals with a parametric multi-channel Wiener filter and a multi-channel de-reverberator, resulting in the direct component; and subtracting from the original frequency domain signals, the direct component, resulting in the diffuse component.

12. The method of claim 1, wherein the combining includes:

adjusting levels of the rendered diffuse channels, at each sub-band of the rendered diffuse channels, so that an estimated output DDR or DRR matches a target DDR or target DRR; and summing the rendered direct channels with the rendered diffuse channels.

13. The method of claim 12, wherein the target DDR or target DRR is based on an energy ratio of the direct component to the diffuse component.

14. The method of claim 12, wherein the target DDR or target DRR is based on a DDR or DRR multiplier received through a user interface or a setting stored in electronic memory.

15. A system for processing input audio channels for generating spatial audio, comprising:

a plurality of microphones, to capture a sound field and generate microphone signals;

a processor; and memory having stored therein a plurality of instructions that, when executed by the processor:

process the microphone signals into corresponding original frequency domain signals having sub-bands of segmented time frames;

extract, from the original frequency domain signals, a direct component in the form of sub-bands of segmented time frames, and a diffuse component in the form of sub-bands of segmented time frames;

process the direct component with a parametric renderer, resulting in a plurality of rendered direct channels;

process the diffuse component with a linear renderer, resulting in a plurality of rendered diffuse channels;

combine, resulting in a spatial audio output; and synthesize the spatial audio output, resulting in a time-domain spatial audio output.

16. The system, according to claim 15, wherein the parametric renderer:

estimates a direction of arrival (DoA) at each sub-band of the direct component, resulting in a plurality of DoA values; and pans a signal using a predefined panning function with the DoA values over output channels, resulting in a plurality of rendered direct channels.

17. The system, according to claim 16, wherein the parametric renderer further performs parameter smoothing of the DoA values, including spatial smoothing, temporal smoothing, or spectral smoothing.

18. The system, according to claim 15, wherein the linear renderer:

generates beamforming weights to a target spatial response using a least-squares fit;

applies the beamforming weights to the diffuse component; and renders the diffuse component over output channels, resulting in a plurality of rendered diffuse channels.

19. The system, according to claim 15, further comprising:

processing, with a second linear renderer, sub-bands of the original frequency domain signal that are greater than a high frequency limit or less than a low frequency limit; and wherein the processing with the parametric renderer includes processing only sub-bands of the direct component that are less than or equal to the high frequency limit or greater than or equal to the low frequency limit, to prevent audible artifacts.

* * * * *